US005475408A

United States Patent [19]

Kanayama

[11] Patent Number: 5,475,408

[45] Date of Patent: Dec. 12, 1995

[54] INK JET HEAD APPARATUS

[75] Inventor: Yoshio Kanayama, Nabari, Japan

[73] Assignee: Sharp Kabushiki Kaisha, Osaka, Japan

[21] Appl. No.: 392,603

[22] Filed: Feb. 22, 1995

Related U.S. Application Data

[63] Continuation of Ser. No. 807,471, Dec. 16, 1991, abandoned.

[30] Foreign Application Priority Data

Jan. 7, 1991 [JP] Japan ..... 3-000242

[51] Int. Cl.[6] ..... B41J 2/045

[52] U.S. Cl. ..... 347/72

[58] Field of Search ..... 347/68–72, 94; 310/328, 330

[56] References Cited

U.S. PATENT DOCUMENTS

| | | | |
|---|---|---|---|
| 3,946,398 | 3/1976 | Kyser et al. | 346/140 R X |
| 4,072,959 | 2/1978 | Elmqvist | 346/140 R |
| 4,459,601 | 7/1984 | Howkins | 346/140 R |
| 4,523,121 | 6/1985 | Takahashi et al. | 310/366 X |
| 4,825,227 | 4/1989 | Fischbeck et al. | 346/140 R X |
| 4,842,493 | 6/1989 | Nilsson | 346/140 R X |
| 4,962,391 | 10/1990 | Kitahara et al. | 346/140 R |

FOREIGN PATENT DOCUMENTS

| | | | |
|---|---|---|---|
| 0443628 | 8/1991 | European Pat. Off. . | |
| 56-120365 | 9/1981 | Japan . | |
| 61-137753 | 6/1986 | Japan . | |
| 0200778 | 9/1987 | Japan | 310/366 |

OTHER PUBLICATIONS

Crooks, W. et al., "Corrosion Protection of Electrodes by Eelctrical Biasing", IBM TDB, vol. 26 No. 6 Nov. 1983 p. 2938.

"Multilayer Transducers", Xerox Disclosure Journal, vol. 8 No. 5 Sep./Oct. 1983, p. 419.

*Primary Examiner*—Benjamin R. Fuller
*Assistant Examiner*—Alrick Bobb
*Attorney, Agent, or Firm*—David G. Conlin; Brian L. Michaelis

[57] ABSTRACT

An ink jet head apparatus includes a piezoelectric actuator having a plurality of laminated piezoelectric elements, each of the piezoelectric elements having a piezoelectric body with a signal electrode and a ground electrode formed on the opposite sides of the piezoelectric body, an ink chamber for storing ink pressurized by a transformation of the piezoelectric actuator, a connecting conductor for the signal electrode through which electrodes having a plurality of the signal electrode are connected to each other, and a connecting conductor for the ground electrode through which electrodes having a plurality of the ground electrode are connected to each other, and the connecting conductor for the ground electrode being located on the side of the ink chamber.

7 Claims, 5 Drawing Sheets

INK JET HEAD APPARATUS

This is a continuation of application Ser. No. 807,471 filed on Dec. 16, 1991, now abandoned.

BACKGROUND OF THE INVENTION

1. Field of the Invention

The present invention relates to an ink jet head apparatus which provides a lamination type piezoelectric actuator.

2. Description of the Related Art

The inventor of the present invention knows that there has been already proposed an ink jet head apparatus which uses a piezoelectric actuator for applying pressure onto ink. The piezoelectric actuator used in the ink jet head apparatus is arranged to have a plurality of laminated piezoelectric elements each having a signal electrode and a ground electrode formed on the opposite sides of the element itself.

The piezoelectric actuator used in the ink jet head apparatus will be described.

As mentioned above, the piezoelectric actuator is arranged to have a plurality of laminated piezoelectric elements. Each piezoelectric element includes as a main body a piezoelectric rectangular board in which distortion or stress takes place depending on the voltage applied on the piezoelectric board. The piezoelectric board provides the signal electrode on one side and the ground electrode on the opposite side. The piezoelectric actuator is, hence, structured to have the signal electrode, the ground electrode, the signal electrode, the ground electrode, the signal electrode, . . . in sequence with the piezoelectric board laid between each pair of the signal electrode and the ground electrode.

The signal electrodes are connected to each other in common and connected to the outside through a connecting conductor. The ground electrodes are connected to each other in common and connected to the outside through another connecting conductor.

As one example of the arrangement, the upper-right portion of the piezoelectric actuator is fixed on a fixing table. The left end of the piezoelectric actuator is built into the ink jet head apparatus so that the left end may face an ink chamber. When a voltage is applied between the signal electrode and the ground electrode, the left end of the piezoelectric actuator serves to press the ink chamber for applying pressure to the ink contained in the ink chamber.

The known ink jet head apparatus is arranged to expose the signal electrodes outside and to locate the connecting conductor for the signal electrode on the left side of the piezoelectric actuator facing to the ink chamber. The arrangement causes erroneous current passage in another piezoelectric actuator through the ink. To overcome this erroneous current passage, it is necessary to strictly carry out the insulating treatment on the side of the piezoelectric actuator facing to the ink chamber. Or, it is necessary to add the insulated leg portion to the left side of the piezoelectric actuator facing to the ink chamber so as to prevent the signal electrodes and the connecting conductor from coming into contact with the ink, The insulating treatment or the addition of the leg portion may result in making the overall structure more complicated, raising the manufacturing cost and lowering the reliability.

SUMMARY OF THE INVENTION

It is therefore an object of the present invention to provide an ink jet head apparatus which provides a simple structured piezoelectric actuator for lowering a manufacturing cost.

The object of the invention can be achieved by an ink jet head apparatus including:

a piezoelectric actuator having a plurality of laminated piezoelectric elements, each of the piezoelectric elements having a piezoelectric body with a signal electrode and a ground electrode formed on the opposite sides of the piezoelectric body;

an ink chamber for storing ink pressurized by a transformation of the piezoelectric actuator;

a connecting conductor for the signal electrode;

a connecting conductor for the ground electrode and the connecting conductor for the ground electrode being located on the side of the ink chamber.

In operation, the piezoelectric actuator is transformed by applying a voltage thereto. The transformation of the piezoelectric actuator applies pressure to the ink contained in the ink chamber and the ink is ejected from the apparatus. The connecting conductor for the ground electrode is located on the side of the ink chamber. Hence, the piezoelectric actuator is allowed to be driven at a low voltage for supplying a high output without having to carry out the special insulating treatment, and since the signal electrodes do not come into contact with the ink chamber, the current passage through an improper actuator is avoidable.

Further objects and advantages of the present invention will be apparent from the following description of the preferred embodiments of the invention as illustrated in the accompanying drawings.

DESCRIPTION OF THE PREFERRED EMBODIMENT

Figure 1:
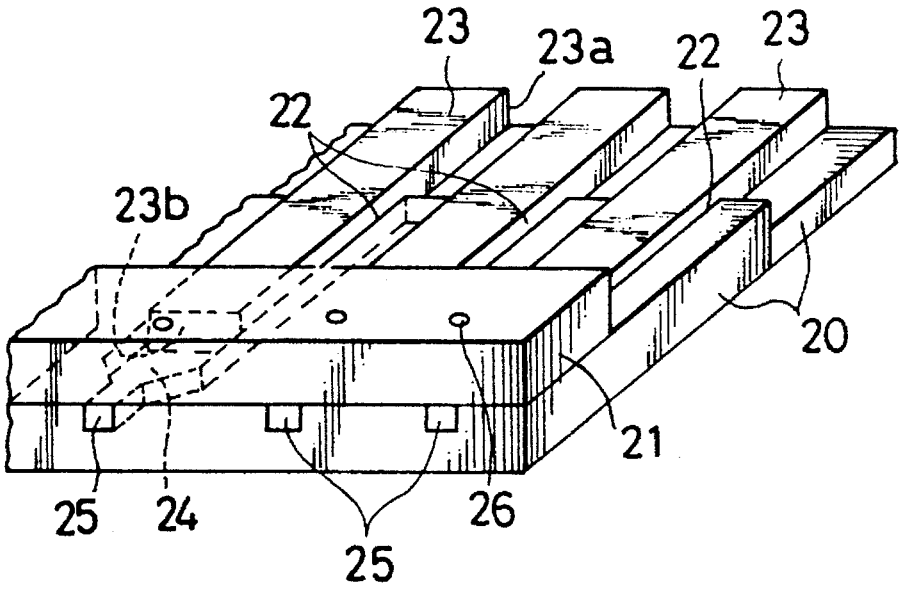
FIG. 1 is a perspective view schematically showing overall structure of an ink jet head apparatus including a piezoelectric actuator according to the present invention.

Embodiments of the present invention will be described in detail as referring to the drawings.

FIG. 1 is a perspective view schematically showing structure of an ink jet head apparatus according to the embodiment of the present invention.

As shown in FIG. 1, a reference numeral 20 denotes a supporting member and a reference numeral 21 denotes a head block member placed on the supporting member 20. The supporting member 20 provides a plurality of grooves 22. Each of piezoelectric actuators 23 is fitted into each of the grooves 22. Each of the grooves 22, each of the piezoelectric actuator 23 fitted to each groove 22 and the head block member 21 compose an ink chamber 24. A nozzle orifice 25 is provided in advance of each ink chamber 24. The head block member 21 provides an ink feeding port 26 communicating with the ink chamber 24. The rear side 23*a* of the piezoelectric actuator 23 is fixed on the supporting member 20 and the front end 23*b* of the piezoelectric actuator 23 comes into direct contact with the ink contained in the ink chamber 24.

Figure 2:
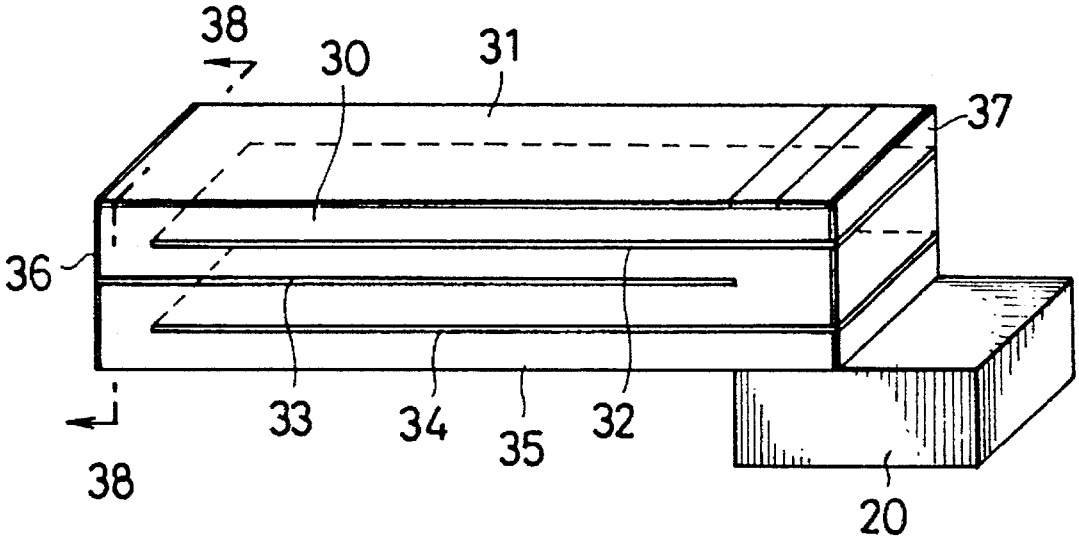
FIG. 2 is a perspective view schematically showing the piezoelectric actuator shown in FIG. 1.

FIG. 2 is a perspective view showing one piezoelectric actuator 23 provided in the ink jet head apparatus.

In FIG. 2, a reference numeral 30 denotes a piezoelectric board made of a square piezoelectric (PZT) ceramics in which transformation, for example, distortion or stress takes place depending on the voltage applied to the piezoelectric board. One piezoelectric element is composed of the piezoelectric board 30 provided with a ground electrode 31 and a signal electrode 32 respectively formed on the opposite sides of the piezoelectric board 30. The piezoelectric actuator is arranged to have a plurality of laminated piezoelectric elements. That is to say, as shown in FIG. 2, the ground electrode 31, the signal electrode 32, the ground electrode 33, the signal electrode 34 and the ground electrode 35 are laminated in sequence with the piezoelectric board laid between each of the ground electrodes and each of the signal electrodes.

The ground electrodes 31, 33 and 35 are connected to each other in common and connected to the outside through a first connecting conductor 36 located on the front (left end in FIG. 2) side facing to the ink chamber 24. The signal electrode 32 and 34 are connected to each other in common and connected to the outside through a second connecting conductor 37 located on the rear (right end in FIG. 2) surface.

The lower-rear (lower-right in FIG. 2) portion of the, piezoelectric actuator is fixed on the supporting member 20 and the left side of the actuator is built in the ink jet head apparatus in a manner to allow the left side to face to the ink chamber 24. When a voltage is applied between the signal electrode and the ground electrode, the front (left in FIG. 2) end serves to press the ink chamber 24 for applying pressure to the ink through a horizontal piezoelectric effect. That is, when a voltage is applied so as to make the signal electrode positive, the front surface facing to the ink chamber 24 is shrunk in the direction perpendicular to the direction of the electric field. Then, by releasing the application of the voltage therebetween, the front surface is restored. The movement is directly transmitted to the ink contained in the ink chamber 24, resulting in ejecting ink drops from the nozzle orifice 25.

In the structure shown in FIG. 2, the front portion indicated by an arrow 38 comes into direct contact with the ink contained in the ink chamber 24. No signal electrodes 32 and 34 and the connecting conductor 37 therefor are provided on this front portion. It means that this front portion provides the ground electrodes 31, 33 and 35 and the connecting conductor 36 therefor located thereon. So, no current passage to another piezoelectric actuator through the ink is made possible if no special insulating treatment is carried out on the front portion. That is to say, in case that a plurality of piezoelectric actuators are provided for composing a multi-actuator, no unfavorable condition takes place where current flows from an adjacent operating channel to an inoperative channel and causes the inoperative channel to erroneously operate, because the conductor coming into direct contact with the ink stays at the ground electric potential. Hence, it is necessary to merely implement the slight insulating treatment on the rear portion of the piezoelectric actuator at which the signal electrodes 32, 34 and the connecting conductor 37 therefor are located. In particular, since the most of the rear portion of the piezoelectric actuator is leveled, it is possible to easily obtain high insulating strength. Further, it is not necessary to carry out the adding treatment on the component so as to prevent the component from coming into contact with the ink. With the above-mentioned piezoelectric actuator, therefore, it is possible to manufacture a highly reliable and inexpensive ink jet head apparatus which is capable of supplying a high output at a low driving voltage. It will be easily understood that the slight insulating treatment is allowed to be done on the front portion of the piezoelectric actuator.

Figure 3:
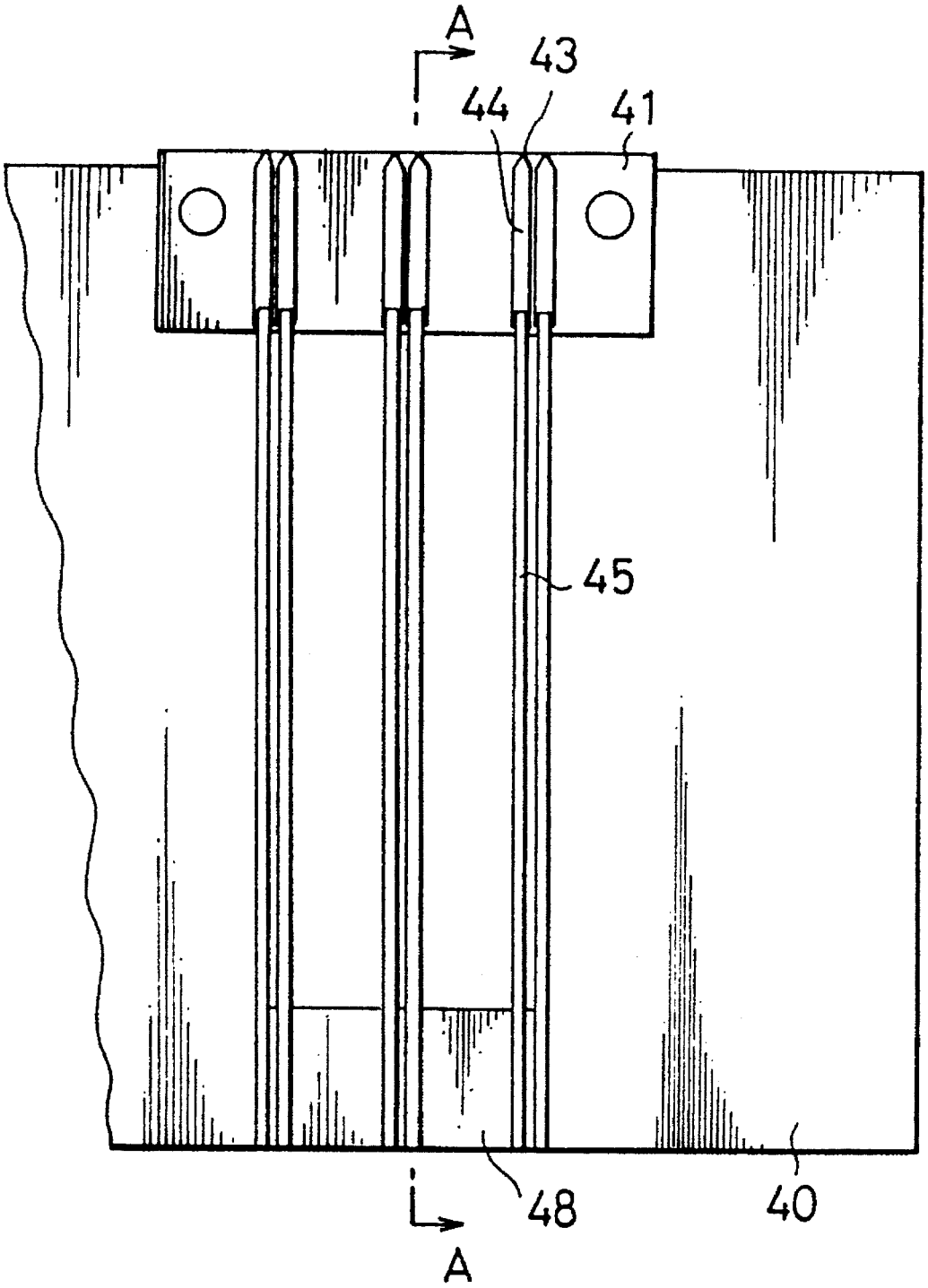
FIG. 3 is a plan view showing an ink jet head apparatus according to an embodiment of the present invention.
Figure 4:
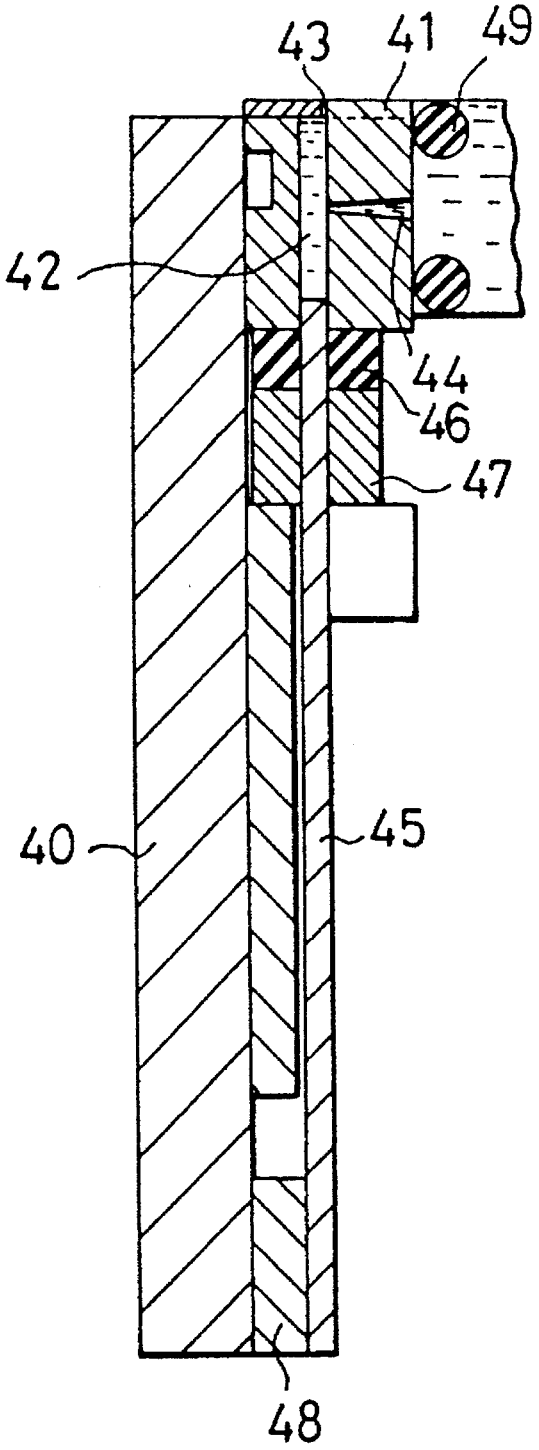
FIG. 4 is a sectional view cut on the line A—A of FIG. 3.

FIG. 3 is a plan view showing an ink jet head apparatus according to an embodiment of the present invention. FIG. 4 is a sectional view cut on the line A—A of FIG. 3.

As shown in FIGS. 3 and 4, a reference numeral 40 denotes a platform, a reference numeral 41 denotes a head block member fixed and placed on the platform 40. The head block member 41 provides a plurality of ink chambers 42, a plurality of nozzle orifices 43 respectively provided at the front portions of these ink chambers 42, and ink feeding ports 44 respectively communicating with the ink chambers 42. The head block member 41 having these ink chambers 42, the nozzle orifices 43 and the ink feeding ports 44 are formed by implementing the etching treatment on a photosensitive glass (PEG), a silicon wafer or a SUS stainless and laminating and connecting the treated material.

The front portion of each piezoelectric actuator 45 as shown in FIG. 2 is fitted into each ink chamber 42 of the head block member 41 and is sealed by a sealing member 46 made of silicon rubber. The sealing member 46 is stopped by a back-up plate 47. The rear end of each piezoelectric actuator 45 is fixed on a supporting member 48 fixed on the platform 40. An O-ring 49 serves to seal a communication port of each ink feeding port 44 to an ink tank (not shown).

The ink jet head apparatus according to the present embodiment is arranged so that the front end of the piezoelectric actuator 45 serves to press the ink chamber 42 for applying pressure to the ink contained in the ink chamber 42 through the horizontal piezoelectric effect. The moving direction of the piezoelectric actuator 45 is parallel to the ink-ejecting direction of the nozzle orifice 43. The ink resonance frequency (Helmholtz frequency) in the ink chamber 42 is 14 kHz.

As is apparent from the above description, the ink jet head apparatus according to the present embodiment is capable of supplying a high output at a low driving voltage and is highly reliable. Further, the ink jet head apparatus can be manufactured at low cost.

Figure 5:
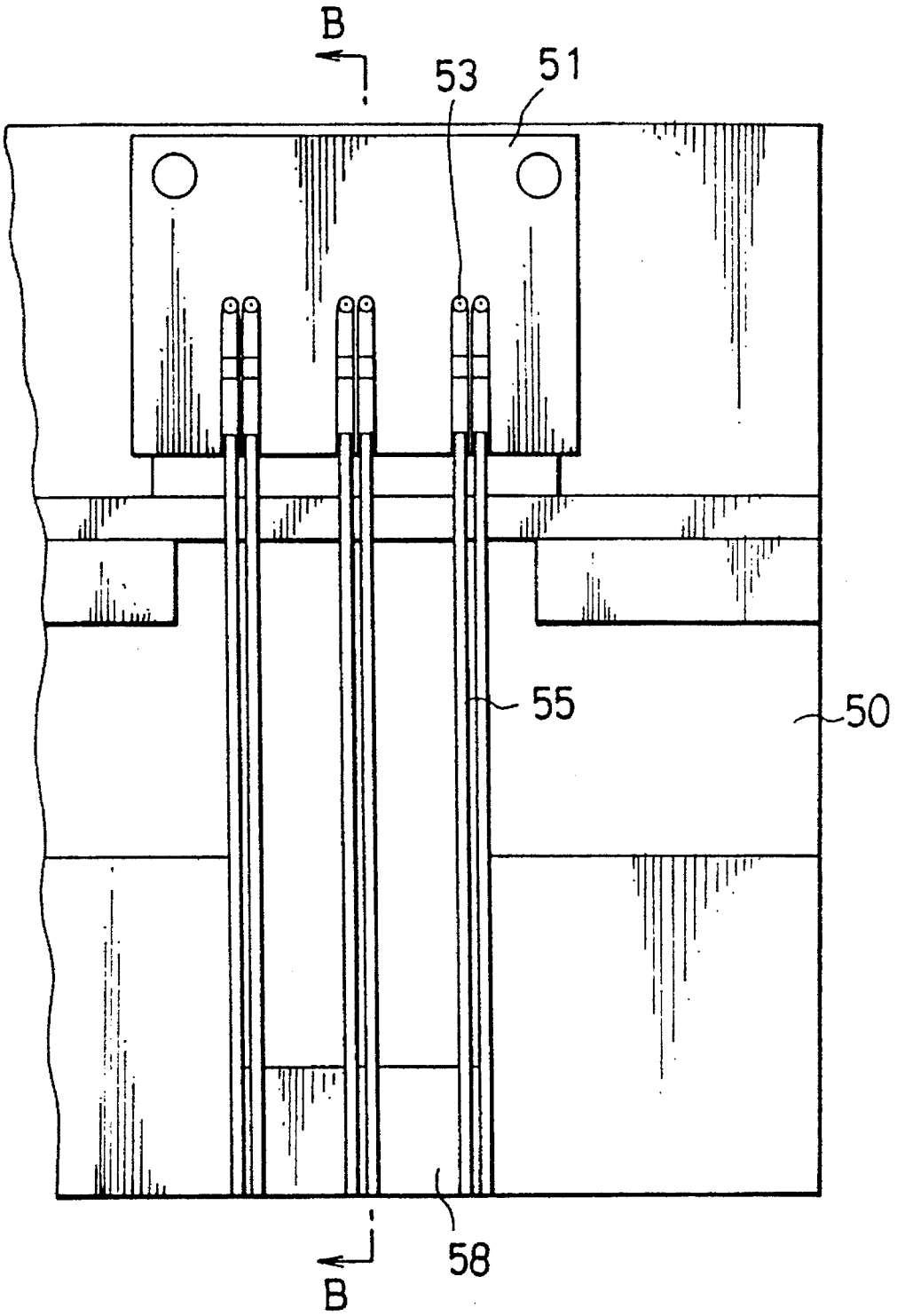
FIG. 5 is a plan view showing an ink jet head apparatus according to another embodiment of the present invention.
Figure 6:
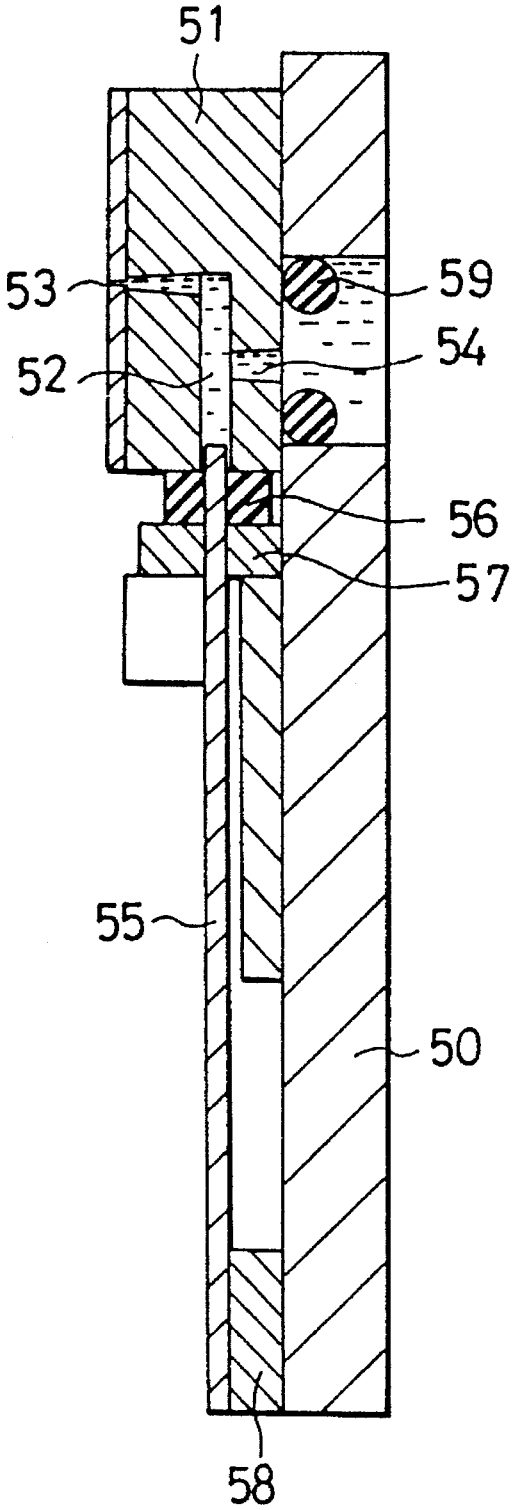
FIG. 6 is a sectional view cut on the line B—B of FIG. 5.

FIG. 5 is a plan view showing an ink jet head apparatus according to another embodiment of the present invention and FIG. 6 is a sectional view cut on the line B—B of FIG. 5.

As shown in FIGS. 5 and 6, a reference numeral 50 denotes a platform. A reference numeral 51 denotes a head block member fixed and placed on the platform 50. The head block member 51 provides a plurality of ink chambers 52, a plurality of nozzle orifices 53 respectively provided at the front portions of these ink chambers 52, and ink feeding ports 54 respectively communicating with the ink chambers 52. The head block member 51 having these ink chambers 52, the nozzle orifices 53 and the ink feeding ports 54 are formed by implementing the etching treatment on a photosensitive glass (PEG), a silicon wafer or a SUS stainless and laminating and connecting the treated material.

The front portion of each piezoelectric actuator 55 as shown in FIG. 2 is fitted into each ink chamber 52 of the head block member 51 and is sealed by a sealing member 56 made of silicon rubber. The sealing member 56 is fixed by a back-up plate 57. The rear end of each piezoelectric actuator 55 is fixed on a supporting member 58 fixed on the platform 50. An O-ring 59 serves to seal a communication port of each ink feeding port 54 to an ink tank (not shown).

The ink jet head apparatus according to the present embodiment is arranged so that the moving direction of the piezoelectric actuator 55 is perpendicular to the ink-ejecting direction of the nozzle orifice 53. The ink resonance frequency (Helmhortz frequency) in the ink chamber 52 is 21 kHz. These are different points from the ink jet head apparatus shown in FIGS. 3 and 4. The other arrangement and operation of this embodiment are the same as those of the embodiment shown in FIGS. 3 and 4.

As is apparent from the above description, the ink jet head apparatus according to the present embodiment is capable of supplying a high output at a low driving voltage and is highly reliable. Further, the ink jet head apparatus can be manufactured at low cost.

Many widely different embodiments of the present invention may be constructed without departing from the spiriting and scope of the present invention. It should be understood that the present invention is not limited to the specific embodiments described in the specification, except as defined in the appended claims.

What is claimed is:

1. An ink jet head apparatus comprising:

a piezoelectric actuator (23, 45, 55) having a plurality of laminated piezoelectric elements, each of said piezoelectric elements including a piezoelectric body (30) with a signal electrode (32) and a ground electrode (31), both of which electrodes being disposed at opposite ends of said piezoelectric body, and having connecting conductors (37, 37) disposed at opposite ends of said piezoelectric actuator, one (36) of said connecting conductors connecting a plurality of ground electrodes (31, 33, 35) of said piezoelectric elements and another (37) of said connecting conductors connecting a plurality of signal electrodes (32, 34) of said piezoelectric elements; and an ink chamber (24, 25, 52) provided with each of said piezoelectric actuator for storing ink to be ejected;

a front end of said piezoelectric actuator being fitted into said ink chamber to provide a portion of said ink chamber, and having a sealing member (46, 56) sealing said front end therein, said front end directly defining a wall surface of said ink chamber such that said wall surface is moveable in a longitudinal direction of the piezoelectric elements to reduce a volume of said ink chamber and eject said ink stored in said ink chamber when a voltage is applied between said connecting conductors of said piezoelectric actuator;

said one (36) of said connecting conductors connecting said ground electrodes disposed at said end of said piezoelectric actuator forming said wall surface of said ink chamber;

the other one (37) of said connecting conductors connecting said signal electrodes disposed at the other end of said piezoelectric actuator, opposite to said ink chamber.

2. An ink jet head apparatus according to claim 1, wherein a moving direction of said piezoelectric actuator is parallel to a direction in which said ink is ejected from said ink chamber.

3. An ink jet head apparatus according to claim 2, wherein an ink resonant frequency in said ink chamber is 14 kHz.

4. An ink jet head apparatus according to claim 1, wherein a moving direction of said piezoelectric actuator is perpendicular to a direction in which said ink is ejected from said ink chamber.

5. An ink jet head apparatus according got claim 4, wherein an ink resonant frequency in said ink chamber is 21 kHz.

6. An ink jet head apparatus according to any one of claims 2 to 5, wherein said piezoelectric body is made of square piezoelectric ceramics.

7. An ink jet head apparatus according to any one of claims 2 to 5, wherein said ink chamber includes a nozzle orifice through which said ink stored in said ink chamber is ejected.

* * * * *